US009635474B2

(12) United States Patent
Kuster

(10) Patent No.: US 9,635,474 B2
(45) Date of Patent: Apr. 25, 2017

(54) METHOD OF PROCESSING A SIGNAL IN A HEARING INSTRUMENT, AND HEARING INSTRUMENT

(75) Inventor: Martin Kuster, Oetwil am See (CH)

(73) Assignee: SONOVA AG, Stafa (CH)

( * ) Notice: Subject to any disclaimer, the term of this patent is extended or adjusted under 35 U.S.C. 154(b) by 509 days.

(21) Appl. No.: 14/119,273

(22) PCT Filed: May 23, 2011

(86) PCT No.: PCT/CH2011/000121
§ 371 (c)(1),
(2), (4) Date: Feb. 5, 2014

(87) PCT Pub. No.: WO2012/159217
PCT Pub. Date: Nov. 29, 2012

(65) Prior Publication Data
US 2014/0177857 A1 Jun. 26, 2014

(51) Int. Cl.
*H04R 25/00* (2006.01)

(52) U.S. Cl.
CPC ..... *H04R 25/407* (2013.01); *H04R 25/43* (2013.01); *H04R 2225/43* (2013.01)

(58) Field of Classification Search
None
See application file for complete search history.

(56) References Cited

U.S. PATENT DOCUMENTS

| | | | | |
|---|---|---|---|---|
| 5,757,937 | A | 5/1998 | Itoh et al. | |
| 5,982,905 | A * | 11/1999 | Grodinsky | H04B 15/00 381/394 |
| 8,121,311 | B2 * | 2/2012 | Hetherington | G10L 21/02 381/93 |
| 2002/0048377 | A1 * | 4/2002 | Vaudrey | H04R 3/005 381/94.7 |
| 2003/0147538 | A1 | 8/2003 | Elko | |
| 2007/0100605 | A1 * | 5/2007 | Renevey | G10L 21/0272 704/201 |
| 2011/0038489 | A1 * | 2/2011 | Visser | G01S 3/8006 381/92 |
| 2011/0058676 | A1 | 3/2011 | Visser | |
| 2012/0051548 | A1 * | 3/2012 | Visser | G10L 21/0208 381/56 |
| 2012/0140946 | A1 * | 6/2012 | Yen | H04R 1/1083 381/92 |

FOREIGN PATENT DOCUMENTS

| | | |
|---|---|---|
| EP | 1465456 | 10/2004 |
| WO | 2004/016041 | 2/2004 |
| WO | 2011/110239 | 9/2011 |

* cited by examiner

*Primary Examiner* — Curtis Kuntz
*Assistant Examiner* — Qin Zhu
(74) *Attorney, Agent, or Firm* — Rankin, Hill & Clark LLP

(57) ABSTRACT

A method of processing a signal in a hearing instrument includes calculating a coherence between two microphone signals or microphone combination signals having different directional characteristics, determining an attenuation from the coherence, and applying the attenuation to the signal.

14 Claims, 3 Drawing Sheets

METHOD OF PROCESSING A SIGNAL IN A HEARING INSTRUMENT, AND HEARING INSTRUMENT

BACKGROUND OF THE INVENTION

Field of the Invention

The invention relates to a method of processing a signal in a hearing instrument, and to a hearing instrument, in particular a hearing aid.

The performance of the signal processing chain in a hearing instrument benefits from an adaptation to the acoustic environment. Examples for such adaptations are dereverberation and beamforming. Especially, dereverberation is an important challenge in signal processing in hearing instruments. Current technologies allow for only a crude estimate of the reverberation time for adaptation. There is a need to improve this.

Description of Related Art

According to a method of the prior art, dereverberation is achieved by convolving the reverberated signal with the inverse of the room impulse response. An early publication in this respect is Neely and Allen, J. Acoust. Soc. Amer. 66, July 1979, 165-169. The room impulse response is either assumed to be known or can be estimated from the audio signal to be reverberated. The latter case is usually referred to as blind deconvolution. Blind deconvolution and blind dereverberation is a field in which still a lot of research takes place.

U.S. Pat. No. 4,066,842 discloses a reverberation attenuation principle where the attenuation is given by the ratio of the cross-power spectral density and the sum of the two auto-power spectral densities. The types of microphones and their spacing are not specified. In an other publication, Allen et al. J. Acoust. Soc. Amer. 62(4), October 1997, the magnitude-square inter-aural coherence function is mentioned as an alternative, and this class of methods is now often referred to as coherence-based methods in literature. Bloom and Cain, IEEE Int. Conf. on ICASSP, May 1982, 184-187 have linked the pp coherence function to the direct-to-reverberant energy (DR) ratio but have failed to mention that the relationship is only correct for wavelengths smaller than the distance between the two microphones.

US 2005/244023 discloses a solution where the exponential decay due to reverberation in speech pauses is detected. Once the decay is detected, the spectrum is attenuated according to an estimate of the reverberant energy.

A method where blind source separation is combined with a coherence-based diffuseness indicator is disclosed in EP 1 509 065.

However, the methods according to the prior art suffer from substantial disadvantages. For dereverberation by deconvolution methods, the required room impulse response is generally not known in the hearing instrument context. Blind methods can currently only produce encouraging results for highly-idealized non-realistic scenarios. Their complexity is also far beyond what can currently be implemented in a hearing instrument. The methods that are based on detecting and attenuating the exponential decay are, in many situations, rather crude, and further improvements would be desirable. The coherence-based methods suffer from the fact that the distance between the two omnidirectional microphones of a hearing instrument is so small that the pp-coherence is virtually identical to unity for direct and diffuse/reverberant sound fields. Better results are achieved when using the binaural coherence, but this requires a binaural link. Also, even then the diffuse/reverberant field coherence will have significant non-zero values for frequencies below about 600 Hz. Several experts in the field have now recognized that the coherence itself may not be the most appropriate parameter to control the spectral attenuation.

BRIEF SUMMARY OF THE INVENTION

It is therefore an object of the present invention to find a technique to improve speech intelligibility in reverberant environments or in other environments with diffuse sound in addition to direct sound. More in particular, it is an object of the invention to provide a method of processing a signal in a hearing instrument and a hearing instrument that overcome drawbacks of prior art dereverberation methods and according hearing instruments and that especially provide satisfactory results for dereverberation without being computationally too expensive, i.e. without being too resource intensive. It is a further object of the invention to provide a method of processing a signal in a hearing instrument that has the potential of providing an improvement in situations with diffuse sound background such as so-called cocktail party or cafeteria or restaurant situations.

In accordance with an aspect of the invention, a method of processing a signal in a hearing instrument comprises the steps of:

calculating a coherence between two microphone signals or microphone combination signals having different directional characteristics determining an attenuation from the coherence, and applying the attenuation to the signal.

In embodiments, the step of determining the attenuation from the coherence comprises calculating, from the coherence, a direct-to-diffuse energy (power) ratio, and determining the attenuation from the direct-to-diffuse energy ratio.

A first insight on which embodiments of the invention are based is that coherence between different acoustic signals contains information on reverberation or other diffuse sound fields. Especially, in a free field (no reverberation, no other distributed weak sound sources), the signals will be coherent, and for example in a reverberant field (the signal consists of reverberation only), the coherence will be very low or even zero.

Generally, the coherence function underlying the principle of embodiments of the invention is able to distinguish between a direct and a diffuse sound field. However, it has been found that it is also a measure to distinguish between direct and reverberant fields. A reverberant sound field yields a similar coherence function (low or no coherence) as a diffuse sound field. A cause for this may be the limited time frames of signal processing (especially of FFT processing steps) used in hearing aid processing. A second insight on which embodiments of the invention are based is that in contrast to the coherence of two pressure microphone signals arranged at some distance to each other, as proposed by some prior art approaches, the coherence of two signals with a different directional characteristics may be indicative of reverberation even for low frequencies. Especially, there is no constraint that the wavelength needs to be smaller than the distance between two microphones used (which latter constraint in hearing instruments is severe, because even in the case of a binaural link the distance between the ears sets a lower limit for the frequency for which the coherence is a measure of the existence of reverberation).

Especially if the signals between which the coherence is used, are measured essentially spatially coincidently, then reverberant signals will cause a coherence of essentially zero if sufficiently short time frames are chosen for signal processing. Measurements of two signals are considered to be essentially spatially coincident if the influence of a spatial variation on the coherence is negligible. For example, at 6 kHz, with a spatial displacement of 5 mm between the measurements the coherence for "reverberant fields" rises from 0 to 0.1. A minimum condition may be that the locations the sound at which they represent are in the same hearing instrument or other device (and not for example in the other hearing instrument of a binaural hearing system or in a hearing instrument and a remote control etc.). In an average case, for practical purposes two sound signals may be considered measured essentially spatially coincidently if the spatial displacement does not exceed 10 mm (i.e. the displacement is between 0 mm and 10 mm), especially if it does not exceed 5 mm, or if it does not exceed 4 mm or 3 mm or 2 mm.

The length of the time frames may for example be substantially less than a typical dimension of a large room in which reverberation may occur (such as 30-50 m) divided by the speed of sound. This may set a maximum time frame length. In many cases, alternatively the reverberation time (that is a well-known property of a particular room) may set an upper limit for the time frames. For example, the time frames may be set that reverberation is addressed even for rooms with a small reverberation time of 0.5 s or less. A minimum length of the time frames may be set by a minimum number of samples for which Fast Fourier transform still yields an appropriate frequency resolution, such as a minimum of 16 samples. This may set a sampling rate dependent minimum length of the time frames. Typically, the minimum length of the time frames can be 3 ms or 6 ms, and a maximum length can 0.5 s or 1 s. Typical ranges for the time frames are between 5 ms and 0.5 s, especially between 5 ms and 0.3 s.

Subsequent time frames may have an overlap, which overlap may be substantial.

In an example, the time frames each comprise 128 samples and have a length of 6.4 ms. They have an overlap of 96 samples.

A third insight on which some embodiments of the invention are based is that the direct-to-diffuse energy ratio (being a direct-to-reverberant energy ratio in a reverberant environment) is a good measure for an attenuation to be applied to the signal. The dependence of the attenuation on the direct-to-diffuse energy ratio may be strictly monotonic within a certain range of direct-to-diffuse ratio values.

The attenuation may be a multiplication with an attenuation factor, or an other dependency on the coherence. In particular, the attenuation can be chosen to depend only on the coherence, and in particular embodiments only on the direct-to-diffuse energy ratio (that is obtained from the coherence), as long as the coherence/direct-to-diffuse energy ratio is in a certain range. Within this range, there may be a bijektive relationship between the coherence direct-to-diffuse energy ratio and an attenuation factor applied to the sound signal. More specifically, the attenuation (factor) is chosen to be independent of any other dynamically changing parameters other than the coherence direct-to-diffuse power ratio; this includes the possibility of providing an influence of the long-term average of the coherence/direct-to-diffuse power ratio or of providing the possibility of a manual setting of different diffuse sound cancellation regimes.

In embodiments, the dependence of the attenuation, for a given frequency, on the coherence/direct-to-diffuse energy ratio is even linear on a logarithmic scale. In an example, the attenuation factor corresponds to the square root of the direct-to-diffuse energy ratio.

$$\hat{P}_{k,l} = \sqrt{\frac{DD_{k,l}}{DD_{max}} P_{k,l}}$$

In this, $DD_{k,l}$ is the direct-to-diffuse (direct-to-reverberant in a reverberant environment) energy ratio in a given frequency band l at a given time frame k. Because the direct-to-diffuse ratio is a measure of power, the square root linearly scales with the amplitude. $P_{k,l}$ is the amplitude of the signal, for example the signal from an omnidirectional microphone or the signal after beamforming. k, l are the time and frequency indices, respectively. $\hat{P}_{k,l}$ is the attenuated signal, and $DD_{max}$ is a maximum value for the expected direct-to-diffuse energy ratio. It need not necessarily be an absolute maximum of the direct-to-diffuse energy over all times. Optionally, the above equation for the attenuation may be modified as follows:

$$\hat{P}_{k,l} = \sqrt{\frac{DD_{k,l}}{DD_{max}} P_{k,l}} \text{ for } DD_{k,l} < DD_{max} \text{ and } \hat{P}_{k,l} = P_{k,l} \text{ otherwise.}$$

The signal to which the attenuation is applied can be one of the microphone signals—for example the pressure (or pressure average) microphone, or a combination of microphone signals—for example a beamformed signal. It is possible that further or other processing steps are applied to the signal prior to the application of the attenuation.

The direct-to-diffuse (DD) power ratio is calculated from the coherence. The used coherence can be a coherence between a pressure signal (which may be a pressure average signal) p and a pressure difference signal (also 'pressure gradient' signal) u. In this, preferably the p signal and the u signal are measured spatially coincident. For example the acoustic centres of the microphones may coincide or a difference between the acoustic centres of the microphones is compensated by a delay. In the following text, the coherence between a pressure signal and a pressure difference signal is sometimes referred to as pu coherence.

In a group of embodiments, the two microphone signals are chosen to be a pressure microphone signal (that may be a pressure average microphone signal) obtained from a pressure microphone and a pressure difference microphone signal (sometimes called "pressure gradient" microphone signal) obtained from a pressure difference microphone (sometimes called "pressure gradient microphone").

In this, the pressure microphone and the pressure difference microphone may share a common acoustic center. In accordance with an alternative definition, in embodiments of this group of embodiments the hearing instrument may comprise a hearing instrument microphone device, the microphone device comprising at least two microphone ports (ports in all embodiments may be sound entrance openings in the hearing instrument casing), a pressure difference microphone in communication with at least two of the ports and a pressure microphone in communication with at least one of the ports, wherein the acoustic center of the ports (which may be a single one of the ports or a plurality of ports) in communication with the pressure microphone is essentially at equal distances from the locations of the ports in communication with the pressure difference microphone.

Especially, the pressure microphone and the pressure difference microphone may be arranged in a common casing, and/or the pressure microphone and the pressure difference microphone may both be coupled to the same plurality of ports (for example two ports), or the pressure difference microphone may be coupled to two ports and the pressure microphone may be coupled to another port in the middle—or, to be more general, on the perpendicular bisector—between the two ports of the pressure difference microphone.

It has been found this group of embodiments features the special advantage that there is no requirement of a critical matching of magnitude and phase of the two microphones.

Microphone devices comprising a p microphone and a u microphone and satisfying the above condition have been described in PCT/CH2011/000082 incorporated herein by reference in its entirety.

In alternative embodiments, the pressure signal p and the pressure difference signal u may be obtained in a conventional manner by combining the signals of two pressure microphones and careful matching the magnitudes and relative phases of the signals. In this case, the spatial coincidence is automatically given.

The direct-to-diffuse energy ratio DD may be calculated from the pu coherence using a suitable equation. As an example, in mixed direct/diffuse sound fields, DD may be expressed as:

$$DD = \frac{-\gamma_{pu}^2(1/2+\cos^2(\theta_0)) - \gamma_{pu}\sqrt{\gamma_{pu}^2(1/4-\cos^2(\theta_0)+\cos^4(\theta_0))+2\cos^2(\theta_0)}}{2\gamma_{pu}^2\cos^2(\theta_0)-2\cos^2(\theta_0)}$$

In this, $\theta_0$ is the angle of incidence and $\gamma_{pu}$ is the pu coherence. There exist approximations that make the calculation computationally less expensive. In a first example of an approximation, $\theta_0$—a generally unknown quantity—is set to be zero. As long as the person wearing the hearing instrument is looking approximately into a direction of the source, this is uncritical causing an error of at most about 2 dB. Another approximation is for example:

$$DD \approx [0.1 + \tan(\gamma_{pu}\pi/2)]$$

The skilled person will come up with other approximations of the above-cited equation for the direct-to-diffuse energy (power) value. As examples, another approximate equation or a lookup table, possibly together with linear or non-linear interpolation, may be used.

The pu coherence in turn may be calculated from the auto- and cross-spectral densities that are for example obtained from an averaging of the products of FFT frames. The averaging may be efficiently done using short-term exponential averaging. The choice of the averaging constant can control the trade-off between the presence of artefacts and the effectiveness of the algorithm.

As an other alternative, instead of a pressure average signal p and a pressure difference signal u, another combination of signals with different directional dependencies may be obtained, for example two cardioid signals of opposite directional characteristics, especially forward and backward facing cardioids. In this, the cardioids should preferably again correspond to the cardioid signals at essentially spatially coincident places.

In a further possible embodiment, the spectral attenuation values are communicated to the respective other hearing instrument by way of binaural communication. For example, the attenuation values may be averaged between the two hearing instruments. This can provide a more stable spatial impression and a reduction in artefacts due to head movement. The exchange can happen with a low bit depth but preferably occurs at or almost at the FFT frame rate.

In many embodiments, the determination of the attenuation factor, as mentioned referring to the mentioned for the direct-to-diffuse power ratio formula, is carried out in a frequency dependent manner, for example in frequency bands. More in particular, the processing steps may be carried out in a plurality of frequency bands and time windows.

In an alternative to the bands given by the FFT algorithm (the FFT bins), processing may occur in Bark bands or other psychoacoustic frequency bands. Apart from being perceptually advantageous, the inherent spectral averaging over the (broader compared to the FFT bins) Bark bands (or other psychoacoustic frequency bands) requires less temporal averaging, which results in faster adaptation dynamics.

As yet another alternative, the coherence is calculated at the FFT bins corresponding to the Bark band (or other psychoacoustic frequency bands) centre frequencies and applied in the logarithmic Bark domain.

In embodiments, an adaptive equalizer can be added to the algorithm: The gains are set according to the separately computed long-termed average (representing steady-state conditions) coherence (or direct-to-diffuse power ratio) as a function of frequency. This may be appropriate if the person wearing the hearing instrument can be assumed to stay in a particular room or reverberant environment for a time that is sufficiently long compared to the average constant. In the frequency domain, a main steady-state effect of reverberation is a frequency dependent increase in magnitude. An adaptive equalizer resulting from an average may compensate for this.

As a further application in addition to reverberant environments, the method according to embodiments of the invention can also be applied to typical cocktail party or cafeteria situations with one stronger source for example positioned at the front of the person wearing the hearing instrument and with a number of weaker sources distributed approximately evenly around the person (diffuse sound field/sometimes one talks about a 'cocktail party effect'). Additionally, in such a situation, all sources are usually reverberated to a certain degree.

The invention also pertains to a hearing instrument or hearing instrument system (for example an ensemble of two hearing instruments coupled to each other via a binaural communication line, or a hearing instrument or two hearing instruments and a remote control communicating with the hearing instrument(s)), the hearing instrument or hearing instrument system comprising a plurality of microphones and a signal processor in communication with the microphones, the processor being programmed to carry out a method according to any one of the embodiments described and/or claimed in the present text.

In this, the signal processor may but does not need to be physically a single processor. Optionally, it may be formed by a single physical microprocessor or other monolithic electronic device. Alternatively, the signal processor may comprise a plurality of signal processing elements communicating with each other. The signal processing elements need not be located physically in the same entity. For example in the case of a hearing instrument system with a remote control, a processing element may be in the remote control, and there may for example carry out at least some of the steps, for example calculation of the coherence and/or (if applicable) calculation of the direct-to-diffuse power ratio; the attenuation factor may be communicated to the hearing instruments by wireless streaming.

In accordance with a second aspect, the invention pertains to a hearing instrument with at least two microphone ports, a pressure difference microphone in communication with at least two of the ports, and a pressure microphone in communication with at least one of the ports, wherein the acoustic center of the ports in communication with the pressure microphone is essentially at equal distances from the locations of the ports in communication with the pressure difference microphone, the hearing instrument further comprising a signal processor in communication with the pressure difference microphone and the pressure microphone and being programmed to carry out the steps of:

calculating a coherence between a signal from the pressure difference microphone and a signal from the pressure microphone;

determining an attenuation from the coherence; and applying the attenuation to the signal.

In particular, the hearing instrument according to this second aspect may be configured according to any previously described embodiment of the first aspect. For example, the signal processor may be programmed so that the step of determining an attenuation factor comprises the sub-steps of calculating from the coherence, a direct-to-diffuse power ratio and calculating the attenuation factor from the direct-to-diffuse power ratio.

In addition or as an alternative, the following features may be, individually or in any combination, incorporated in embodiments of the second aspect of the invention.

The step of determining the attenuation comprises determining an attenuation factor, and applying the attenuation to the signal comprises applying the attenuation factor to the signal.

The step of calculating the coherence is carried out in a plurality of frequency bands and in finite time windows, and the step of applying the attenuation to the signal is carried out in a frequency dependent manner. In this, the frequency bands may be FFT bins or psychoacoustic frequency bands (Bark bands etc.), or other frequency bands.

The coherence values or values derived therefrom may be exchanged with a further hearing instrument of a binaural hearing instrument system.

Embodiments of all aspects of the invention may further comprise the option of a beamformer that combines the signals of the plurality of microphones in a manner that the signals incident on the microphones are amplified/attenuated in a manner that depends on the direction of incidence.

In embodiments of both aspects comprising a p microphone and a u microphone, a correction filter, especially a static correction filter may be applied to at least one of the pressure microphone signal and the pressure difference microphone signal, prior to combining the signals for beamforming. Such a static correction filter may for example be of the kind disclosed in the mentioned PCT/CH2011/000082.

In embodiments of both, the first and second aspects, instead of determining the attenuation from the direct-to-diffuse power ratio, the attenuation could also be determined directly from the coherence using any appropriate mathematical relationship. Generally, at least in a range of coherence values, an attenuation factor will be a monotonically rising function of the coherence, being at a maximum (no attenuation) when the coherence is 1 and at a minimum (strong attenuation) when the coherence is 0. In a particularly simple embodiment, the attenuation factor can be chosen to be proportional to the coherence.

In accordance with a further aspect of the of the invention, a method of processing a signal in a hearing instrument comprises the steps of:

calculating a coherence between two microphone signals or microphone combination signals, calculating, from the coherence, a direct-to-diffuse energy (power) ratio, determining an attenuation from the direct-to-diffuse energy ratio, and applying the attenuation to the signal.

Also in this third aspect, the method may be implemented in accordance with the first aspect. In also in this third aspect, the following options exist.

The step of determining the attenuation may comprise determining an attenuation factor, and applying the attenuation to the signal may comprise applying the attenuation factor to the signal.

At least within a range of direct-to-diffuse power ratios, the attenuation factor may be chosen to be a square root of the ratio of the direct-to-diffuse power ratio and a maximum direct-to-diffuse power ratio value.

At least within a range of direct-to-diffuse power ratios, the attenuation may be chosen to be independent of dynamically changing parameters other than a direct-to-diffuse power ratio or a plurality of direct-to-diffuse power ratios (this holds for embodiments in which the attenuation factor is the square root of the ratio of the direct-to-diffuse power ratio, and to embodiments where this is not the case).

The microphone signals or microphone combination signals may be a pressure signal and a pressure difference signal. Optionally, the pressure signal may be obtained from a pressure microphone and the pressure difference signal may be obtained from a pressure difference microphone. Also this option may be combined with any one of the precedingly itemized options.

The hearing instrument may comprise at least two microphone ports, a pressure difference microphone in communication with at least two of the ports and a pressure microphone in communication with at least one of the ports, wherein the acoustic center of the ports in communication with the pressure microphone is essentially at equal distances from the locations of the ports in communication with the pressure difference microphone.

The steps of calculating the coherence, and of calculating the direct-to-diffuse power ratio may be carried out in a plurality of frequency bands and in finite time windows, and wherein the step of applying the attenuation to the signal is carried out in a frequency dependent manner. Also this option may be combined with any one of the precedingly itemized options.

When the calculation is carried out in a plurality of frequency bands, the frequency bands may be fast Fourier transform bins or psychoacoustic frequency bands or other frequency bands. The attenuation in each frequency band may be determined to depend on an average of the direct-to-diffuse power ration over a plurality of frequency bands.

The method may comprise the further step of receiving a further direct-to-diffuse power ratio from another hearing instrument of a binaural hearing instrument system and of determining an average of the direct-to-diffuse power ratio and the further direct-to-diffuse power ratio. Also this option may be combined with any one of the precedingly itemized options.

The term "hearing instrument" or "hearing device", as understood in this text, denotes on the one hand classical hearing aid devices that are therapeutic devices improving the hearing ability of individuals, primarily according to diagnostic results. Such classical hearing aid devices may be Behind-The-Ear (BTE) hearing aid devices or In-The-Ear (ITE) hearing aid devices (including the so called In-The-Canal (ITC) and Completely-In-The-Canal (CIC) hearing aid devices and comprise, in addition to at least one microphone and a signal processor and/or, amplifier also a receiver that creates an acoustic signal to impinge on the eardrum. The term "hearing instrument" however also refers to implanted or partially implanted devices with an output side impinging directly on organs of the middle ear or the inner ear, such as middle ear implants and cochlear implants.

Further, the term also stands for devices that may improve the hearing of individuals with normal hearing by being inserted—at least in part—directly in the ears of the individual, e.g. in specific acoustical situations as in a very noisy environment.

BRIEF DESCRIPTION OF THE DRAWINGS

Hereinafter, embodiments of methods and devices according to the present invention are described in more detail referring to the figures. In the drawings, same reference numerals refer to same or analogous elements. The drawings are all schematical.

DETAILED DESCRIPTION OF THE INVENTION

Figure 1:
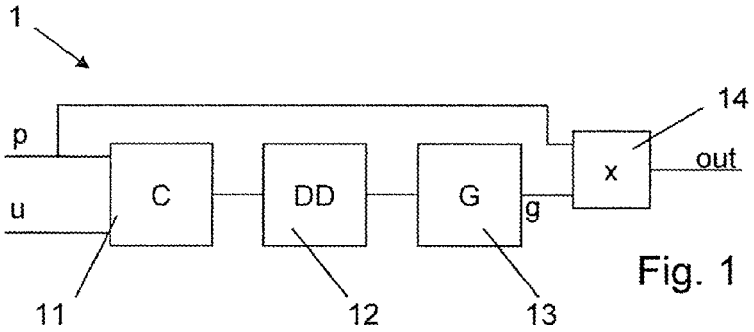
FIG. 1 is a schematic that shows a scheme of signal processing in accordance with a first basic embodiment of the invention.

In accordance with FIG. 1, a pressure or pressure average signal p and a pressure difference or pressure gradient signal u are obtained, for example by a pressure microphone and a pressure difference microphone. The pressure microphone and the pressure difference microphone may be part of a microphone device as described and claimed in PCT/CH2011/000082. Alternatively, the pressure average signal p and the pressure difference signal u may be obtained in a conventional manner by combining the signals of two pressure microphones, carefully matching the magnitudes and relative phases of the signals as for example disclosed in EP 0 652 686 (Cezanne, Elko). As yet another alternative, instead of a pressure average signal p and a pressure difference signal u, another combination of signals with different directional dependencies may be obtained, for example two cardiod signals of opposite directional characteristics, as again disclosed in EP 0 652 686.

In a signal processing/dereverberation stage 1 (this includes applications where the diffuse sound comes from another source than reverberation), an output signal out is obtained from the microphone or microphone combination signals with different directional characteristics. In a coherence calculating stage 11, the coherence of the p and u signals is calculated. Coherence between two signals x and y is defined as:

$$\gamma_{xy}^2 = \frac{|\langle XY^* \rangle|^2}{\langle XX^* \rangle \langle YY^* \rangle}$$

where X and Y are the spectral densities of the signals x and y and * denotes the complex conjugate. Estimating the spectral densities may involve segmenting the signals into blocks and, after applying the Fast Fourier Transform (FFT) to each block, averaging over all blocks. Methods of calculating the coherence between two signals are known in the art and will not be described any further herein.

In a subsequent Direct-to-Diffuse energy ratio (DD) calculating stage 12, from the calculated coherence a DD is obtained. This may for example be done by an equation of the kind mentioned hereinbefore linking the DD ratio with the pu coherence.

Thereafter, in a gain calculating stage 13, the gain (or attenuation factor) G is obtained from the direct-to-diffuse energy ratio DD. It is applied (multiplication 14) to the signal—for example to the pressure average signal—to yield an attenuated signal (out) that is converted in an acoustic signal by a receiver; optionally, the attenuated signal may be further processed in accordance with the needs of the person wearing the hearing instrument before being supplied to the receiver.

In preferred embodiments, the attenuation is calculated in a frequency dependent manner. Especially, it may be calculated and applied independently in a plurality of frequency bands. The frequency bands may optionally be based on a psychoacoustic scale, such as the Bark scale or the Mel scale, and they may have equidistant band edges in such a psychoacoustic scale.

Figure 2:
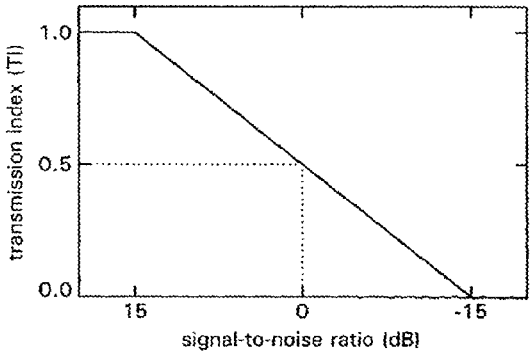
FIG. 2 is a graph that shows the relationship between a signal-to-noise ratio (SNR) and speech transmission index (TI) for persons with normal hearing.

FIG. 2 depicts, for a person with normal hearing, a relationship between the signal-to-noise ratio and the speech transmission index according to "Basics of the STI-measuring method", H J M Steeneken and T Houtgast. According to this, the dependence is linear in a range between 15 dB and −15 dB. For a hearing impaired person, the range will be shifted to higher SNR values but may be expected to be again approximately linear.

Reverberation or diffuse sound, like (other) noise, decreases intelligibility and can be counted as noise, the DD ratio in the context of the present invention can be viewed as equivalent to the SNR ratio if only one source is present. For this reason, the DD ratio is a good measure for estimating intelligibility of a reverberated acoustic signal and consequently a good basis for the calculation of an attenuation factor.

Figure 3:
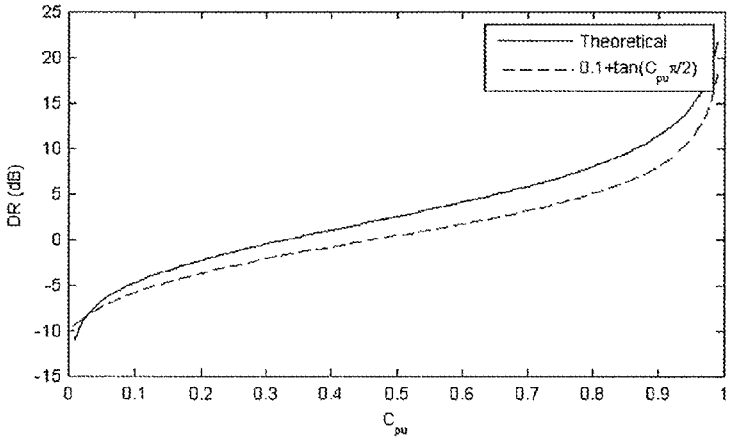
FIG. 3 is a graph that shows the relationship between the pu coherence $C_{pu}$ and the direct-to-reverberant energy ratio DR (corresponding to the direct-to-diffuse energy ratio DD if the diffuse sound is due to reverberation) according to a theoretical model (solid line) and according to the approximation $DR=0.1+\tan(C_{pu}\pi/2)$ (dashed line)

FIG. 3 shows the relationship between the pu-coherence and the DD ratio. It can be seen that the algorithm operates in the SNR range between −10 dB and 20 dB where intelligibility is changing and the attenuation (in dB) is linearly related to it. A non-linear relationship is also conceivable, provided that the attenuation range is not too large.

It has been found that an attenuation range much larger (larger by factors) than 30 dB can lead to audible artifacts.

Figure 4:
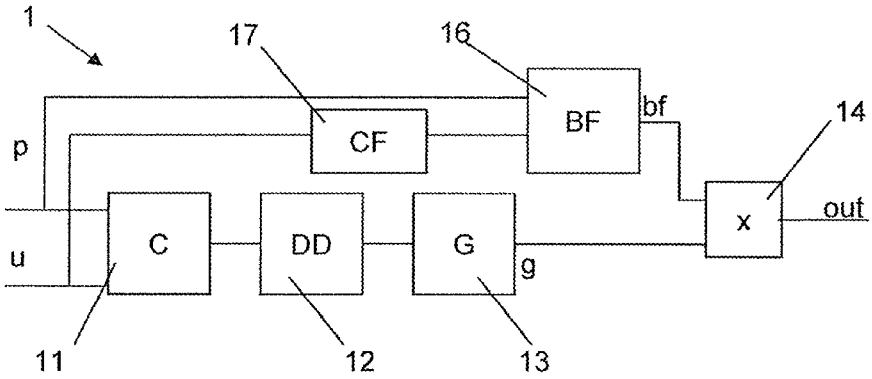
FIG. 4 is a schematic that shows a scheme of signal processing in accordance with a second basic embodiment of the invention.

The signal processing/dereverberation stage 1 of the embodiment of FIG. 4 is distinct from the embodiment of FIG. 1 in that it the two signals (p, u) are not only used for dereverberation/diffuse noise suppression in accordance with the hereinbefore explained methods but are additionally used for beamforming. Beamforming (directional signal reception) based on two microphone signals, for example the microphone signals of two p microphones, is a technique known in the field of signal processing in hearing instruments. Beamforming in hearing aids is known for improving the intelligibility and quality of speech in noise. Beamforming based on a p and an u signal obtained a pressure average microphone and from a pressure difference microphone has recently been described in the application PCT/CH2011/000082 incorporated herein by reference. In the depicted embodiment, a beamforming stage 16 is used for calculating a beamformed signal bf from the pressure average signal p and the pressure difference signal. The beamformed signal bf is then attenuated or not according to the result g of the gain calculation. Before being fed to the beamformer, at least one of the signals p, u (the u signal in the depicted embodiment) is supplied to a correction filter 17. In the depicted configuration, a correction filter 17 is applied to the pressure difference microphone signal. The correction filter may be a static correction filter, i.e. a filter with a set frequency dependence. The purpose of the correction filter is to adjust the signals for different frequency responses of the pressure microphone and of the pressure difference microphone. The filter characteristics may be determined by measurements and/or calculations.

In all embodiments comprising beamforming, the beamformer may be an adaptive beamformer. Alternatively, the beamformer may have a static directivity.

Figure 5:
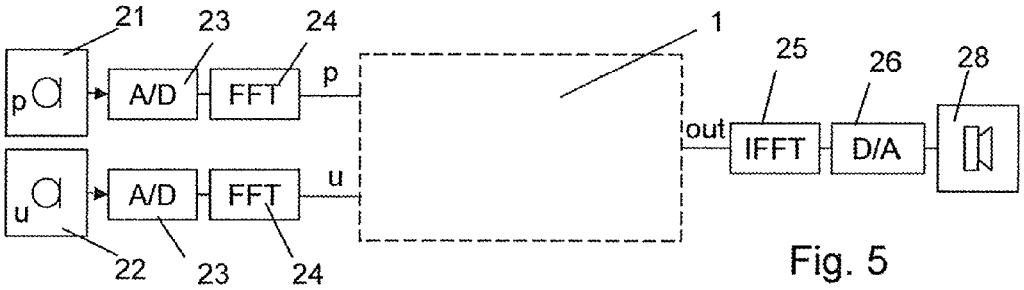
FIG. 5 is a schematic that shows a scheme of a hearing instrument.

A scheme of a hearing instrument is depicted in FIG. 5. The hearing instrument comprises a (physical) p microphone 21 and a (physical) u microphone 22. The respective signals are processed in an analog-to-digital converter 23 and in a fast Fourier transform stage 24 to yield the p and u signals that serve as input for the embodiments of the signal processing/dereverberation stage 1. An Inverse Fast Fourier Transform (IFFT) stage 25 transforms the out signal back into the time domain, and a digital-to-analog conversion 26—and potentially an amplifier (not depicted)—feed the signal to the receiver(s) 28 of the hearing instrument. In addition to dereverberation/noise canceling, further signal processing may be used to correct for hearing deficiencies of the hearing impaired person if necessary.

Figure 6:
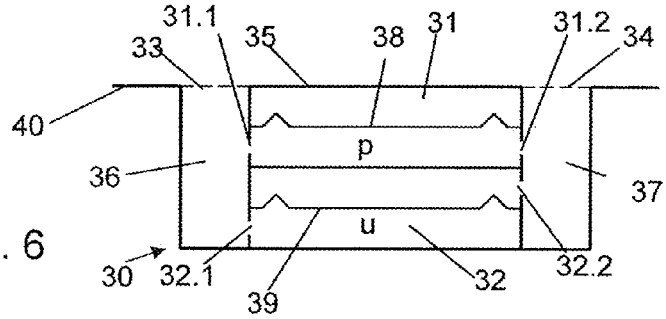
FIG. 6 is a schematic that depicts an instrument device of embodiments of hearing instruments according to the invention.

The microphone device 30 depicted in FIG. 6 is a basic version of a combination of a pressure microphone 31 and a pressure difference microphone 32 with a common effective acoustic center illustrating the operating principle. The microphone device comprises a first port 33 and a second port 34, the ports being arranged at a distance from each other.

The pressure microphone 31 and the pressure difference microphone 32 are arranged in a common casing 35.

The pressure microphone 11 is formed by a pressure microphone cartridge and comprises a membrane 38 that divides the cartridge in two volumes. The first volume is coupled, via sound inlet openings 31.1, 31.2 of the cartridge, and via tubings 36, 37, to the first and second ports, respectively, whereas the second volume is closed. The pressure microphone, as is known in the art, due to its construction is not sensitive to the direction of incident sound.

The pressure difference microphone 32 is formed by a pressure microphone cartridge and comprises a membrane 39 that divides the cartridge in two volumes. The first volume is coupled via a first sound inlet opening 32.1 of the cartridge and via first tubing 36, to the first port 33, and the second volume is coupled, via a second sound inlet opening 32.2 of the cartridge and via second tubing 37, to the second port 34. Due to this construction, the pressure difference microphone 32 is sensitive to the sound direction A property of the embodiment of FIG. 6, and of other embodiments, is that the pressure microphone is open to both ports. As a consequence, the (effective) acoustic centers of the pressure microphone and of the pressure difference microphone coincide.

In the depicted configuration, the pressure microphone cartridge and the pressure difference microphone cartridge are both formed by the common casing 35 and an additional rigid separating wall that divides the casing volume between the two cartridges. This construction, however, is not a requirement. Rather, other geometries are possible, the sizes and/or shapes of the cartridges and/or the orientation of the membranes need not been equal, and/or between the pressure microphone cartridge and the pressure difference microphone cartridge, other objects may be arranged.

The ports may further comprise a protection as indicated by the dashed line, for example of the kind known in the field.

The ports 33, 34 may be small openings in the casing 40 of the hearing instrument in of which the microphone device is a part.

Generally, the tubings 36, 37 can be any sound conducting volumes that connect the ports with the respective openings, the word 'tubing' not being meant to restrict the material or geometry of the sound conducting duct from the ports to the sound inlet openings. In other words the tubing may comprise flexible tubes or rigid ducts or have any other configuration that allows for a communication between the ports and the sound inlet openings of the microphones.

In an alternative to the depicted embodiment, the ports 33, 34 may be spaced further apart than an extension of the p and u microphone cartridges.

Figure 7:
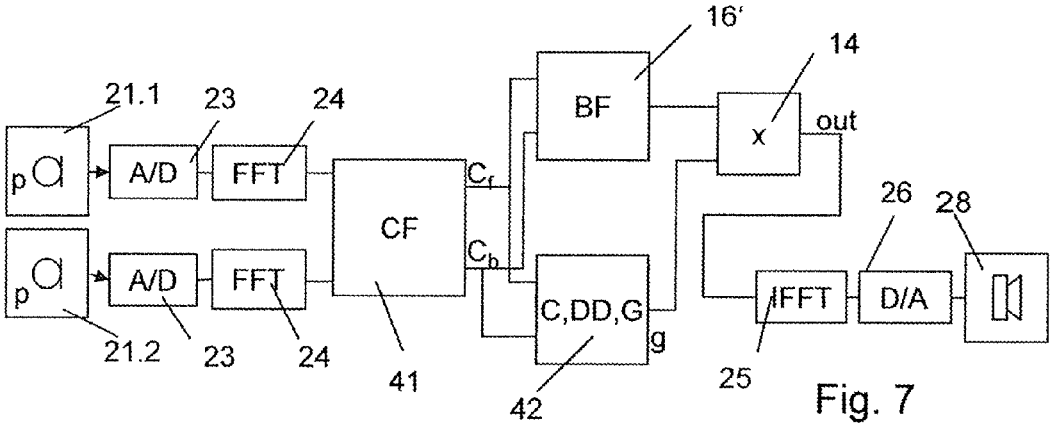
FIG. 7 is a schematic that shows a scheme of a hearing instrument device with two pressure microphones and with beamforming.

FIG. 7 shows an alternative embodiment of a hearing instrument. The microphone combinations signals with different directional characteristics are obtained from two pressure microphones 21.1, 21.2 arranged at a distance to each other. A cardioid forming stage CF 41 calculates from the combination of the signals generated by the microphones 21.1, 21.2 a Front Cardioid $C_f$ and a Back Cardioid $C_b$. The cardioid signals $C_f$, $C_b$ are on the one hand processed by a coherence calculating/direct-to-diffuse power calculating/attenuation factor determining stages 42 to yield an attenuation g. On the other hand, a beamformer 16' generates a beamformed signal that depends on the direction of incidence on the microphones. The attenuation g is applied to the beamformed signal before being processed by IFFT and D/A transformation (and amplification if necessary) as in the previous embodiments.

What is claimed is:

1. A method of processing a signal in a hearing instrument, the method comprising the steps of:

calculating a coherence between a plurality of microphone signals or microphone combination signals, wherein the microphone signals or microphone combination signals have different directional characteristics and are measured spatially coincidentally;

determining an attenuation from the coherence; and applying the attenuation to the signal;

wherein the step of determining the attenuation comprises the sub-steps of calculating, from the coherence, a direct-to-diffuse power ratio, and of determining the attenuation from the direct-to-diffuse power ratio.

2. The method according to claim 1, wherein the step of determining the attenuation comprises determining an attenuation factor, and wherein applying the attenuation to the signal comprises applying the attenuation factor to the signal.

3. The method according to claim 1, wherein at least within a range of direct-to-diffuse power ratios the attenuation factor is chosen to be a square root of the ratio of the direct-to-diffuse power ratio and a maximum direct-to-diffuse power ratio value.

4. The method according to claim 1, wherein at least within a range of coherence values, the attenuation is chosen to be independent of dynamically changing parameters other than the coherence or a plurality of coherence values or a quantity that depends on the coherence or coherence values.

5. The method according to claim 1, wherein the microphone signals or microphone combination signals are a pressure signal and a pressure difference signal.

6. The method according to claim 5, wherein the pressure signal is obtained from a pressure microphone and the pressure difference signal is obtained from a pressure difference microphone.

7. The method according to claim 6, wherein the hearing instrument comprises at least two microphone ports, a pressure difference microphone in communication with at least two of the ports and a pressure microphone in communication with at least one of the ports, wherein the acoustic center of the ports in communication with the pressure microphone is at equal distances from the locations of the ports in communication with the pressure difference microphone.

8. The method according to claim 1, wherein the step of calculating the coherence is carried out in a plurality of frequency bands and in finite time windows, and wherein the step of applying the attenuation to the signal is carried out in a frequency dependent manner.

9. The method according to claim 8, wherein the frequency bands are fast Fourier transform bins.

10. The method according to claim 8, wherein the frequency bands are psychoacoustic frequency bands.

11. The method according to claim 8, wherein the attenuation in each frequency band is determined to depend on an average of the coherence values over a plurality of frequency bands and/or over a plurality of time frames.

12. The method according to claim 1, comprising the further step of receiving a further coherence value or quantity that depends on the coherence from another hearing instrument of a binaural hearing instrument system and of determining an average of the coherence or quantity depending thereon and the coherence value or quantity depending thereon.

13. A hearing instrument or hearing instrument system, comprising a plurality of microphones and a signal processor in communication with the microphones, the processor being programmed to carry out a method comprising the steps of:

calculating a coherence between a plurality of microphone signals or microphone combination signals, wherein the microphone signals or microphone combination signals have different directional characteristics and are measured spatially coincidentally;

determining an attenuation from the coherence; and applying the attenuation to the signal;

wherein the step of determining the attenuation comprises the sub-steps of calculating, from the coherence, a direct-to-diffuse power ratio, and of determining the attenuation from the direct-to-diffuse power ratio.

14. The hearing instrument according to claim 13, comprising at least two microphone ports, a pressure difference microphone in communication with at least two of the ports, and a pressure microphone in communication with at least one of the ports, wherein the acoustic center of the ports in communication with the pressure microphone is at equal distances from the locations of the ports in communication with the pressure difference microphone.

* * * * *